United States Patent [19]

Friedman, Jr. et al.

[11] 4,169,279

[45] Sep. 25, 1979

[54] METHOD FOR NEUTRALIZING STATIC ELECTRICITY WITH MIXED ATMOSPHERES

[75] Inventors: Lester A. Friedman, Jr.; James D. Faulkner, both of Atlanta, Ga.

[73] Assignee: Lester Laboratories, Inc., Atlanta, Ga.

[21] Appl. No.: 945,753

[22] Filed: Sep. 25, 1978

[51] Int. Cl.[2] ..... H05F 3/00

[52] U.S. Cl. ..... 361/212

[58] Field of Search ..... 361/212, 215, 214, 218, 361/231, 229, 225

[56] References Cited

U.S. PATENT DOCUMENTS

| | | | |
|---|---|---|---|
| 2,043,217 | 6/1936 | Yaglou | 361/231 |
| 2,386,647 | 10/1945 | Andresen | 361/218 |
| 3,123,640 | 3/1964 | Longley | 361/212 |
| 3,123,641 | 3/1964 | Longley | 361/212 |
| 3,730,193 | 5/1975 | Armistead | 361/215 |
| 3,888,678 | 6/1975 | Bailey, Jr. et al. | 361/212 |
| 3,984,731 | 10/1976 | Martin | 361/212 |

FOREIGN PATENT DOCUMENTS

| | | | |
|---|---|---|---|
| 1053688 | 3/1959 | Fed. Rep. of Germany | 361/214 |
| 195386 | 2/1924 | United Kingdom | 361/214 |
| 381185 | 7/1973 | U.S.S.R. | 361/212 |

*Primary Examiner*—J D Miller
*Assistant Examiner*—L. Schroeder
*Attorney, Agent, or Firm*—Beveridge, DeGrandi, Kline & Lunsford

[57] ABSTRACT

A method for simultaneously neutralizing positive and negative static electric charges on surfaces consisting essentially of contacting a first atmosphere with a positive static charge composition (108) by spraying (125) an effective amount of the composition into the atmosphere, contacting a second atmosphere with a negative static charge composition (8) by spraying (25) an effective amount of the negative static charge composition into the second atmosphere, mixing (126) the resulting treated first atmosphere with the resulting treated second atmosphere to thereby form a mixed atmosphere, and contacting at least one surface (16) having positive and negative static electric charges thereon with the mixed atmosphere to thereby simultaneously neutralize positive and negative static charges on the surface.

19 Claims, 1 Drawing Figure

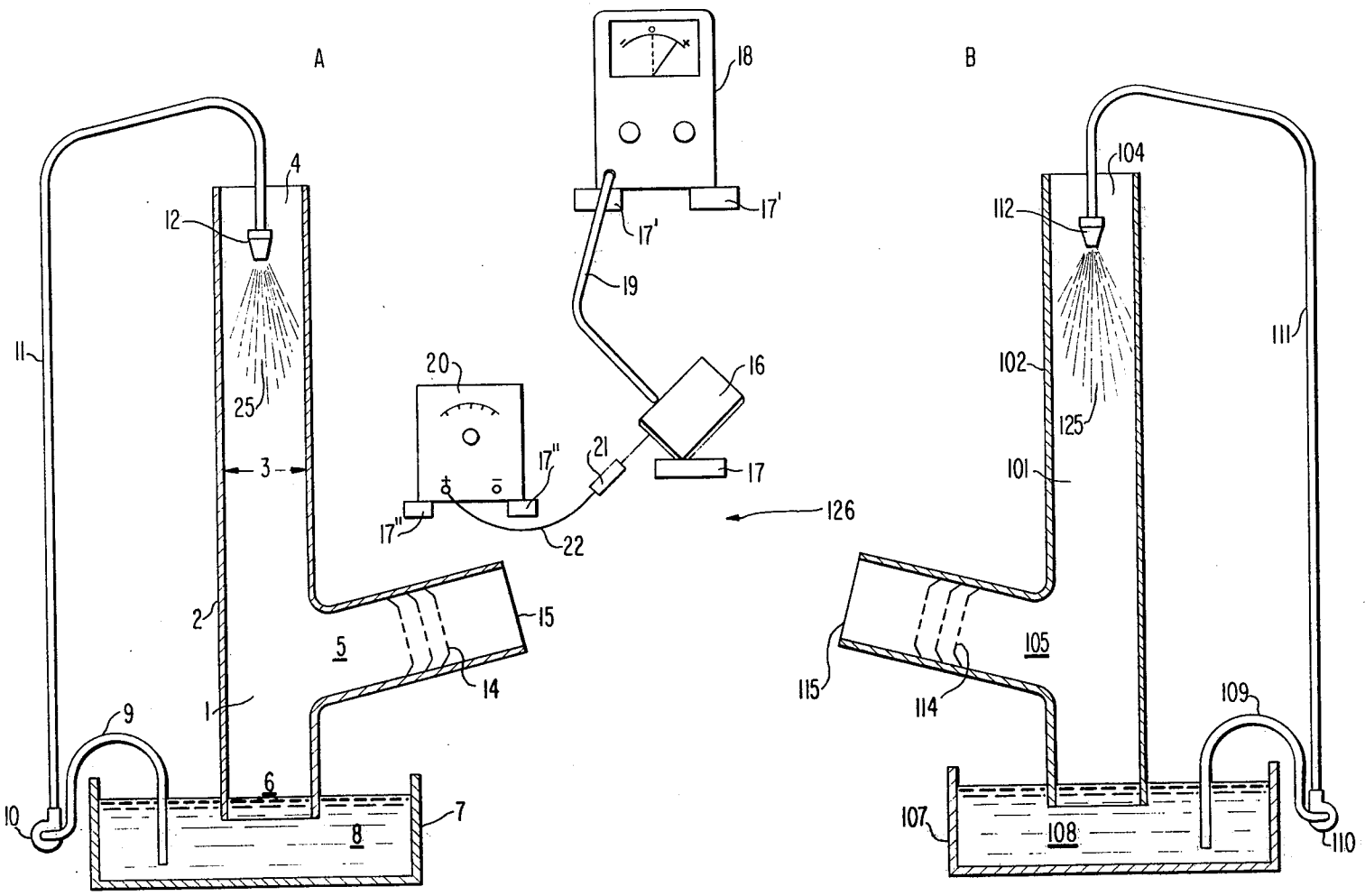
A
B
1
2
3
4
5
6
7
8
9
10
11
12
14
15
16
17
17'
17''
18
19
20
21
22
25
101
102
104
105
107
108
109
110
111
112
114
115
125
126

METHOD FOR NEUTRALIZING STATIC ELECTRICITY WITH MIXED ATMOSPHERES

TECHNICAL FIELD

This invention relates to a process for simultaneously neutralizing positive and negative static electric charges on surfaces. More particularly, static electric charges are simultaneously neutralized by contacting the surfaces with a mixed stream formed by mixing a stream treated with a positive charge composition with another stream treated with a negative charge composition.

BACKGROUND ART

Friction between objects of different molecular structures creates static electric charges. This problem is particularly acute in the textile industry where certain textile processing operations require frictional contact between a yarn and various mechanical devices. Depending upon the nature of the yarn, positive or negative charges build up and often lead to deleterious consequences. A safe, economical means of controlling both positive and negative static electricity is, therefore, of considerable interest to the textile industry.

Many attempts have been made in the past to neutralize static electricity. One of the approaches commonly employed involves Corona discharge electrostatic devices and another employs chemical additives, which are introduced into air-wash devices used in textile plants. Corona discharge devices suffer from their inability to produce long-lived charges on the particles they depend upon. Most anti-static formulations marketed for use in air-washers suffer from a lack of flexibility in that they are only able to solve half the problem existing in the control of static electricity; that is to say, they are capable of neutralizing either positive or negative static charges, but not both.

U.S. Pat. No. 3,924,157 and U.S. Pat. No. 4,077,914, to Peters and McAmish and assigned to the same assignee of the present application each that an aqueous solution of borax and a surfactant can be sprayed into a gaseous stream to impart a net positive electrical charge to the stream. It would be ideal if a method capable of neutralizing both positive and negative static charges could be provided. Similarly, U.S. Pat. No. 3,939,080 and U.S. Pat. No. 3,984,731 teach that dodecylbenzyl triethyl ammonium chloride can be added to an air-washer that delivers a flow of air to a room in which static electricity is present. Only negative static charges on objects are neutralized to any great extent. Thus, dodecylbenzyl triethyl ammonium chloride operates in a manner similar to a mixture of borax and a surfactant in that each imparts a predominantly net positive charge to an air stream.

Other methods for imparting a charge to a gaseous atmosphere are also known in the art, but each has its unique limitations. For example, merely contacting a gaseous stream with a water spray has been found sufficient to impart an electrical charge to the stream, but mainly only a negative electrical charge.

In other cases, a high electrical potential is applied to a water spray before being contacted with the gaseous stream. This method has not proved entirely satisfactory because of the electrical energy requirements, the safety hazards involved and periodic equipment breakdowns. Still other methods involve the use of radioactive substances. These methods have not proved entirely satisfactory because of the cost of the radioactive materials, the hazards involved in handling such materials and the cost of the safeguards that must be provided.

Thus, there exists a need in the art for a process for discharging both positive and negative static build-up. The process should be of relatively low cost to operate, fairly simple and safe to use without the need for costly equipment. The process should ideally be suited for use with existing air-wash systems in textile plants.

DISCLOSURE OF INVENTION

Accordingly, this invention aids in fulfilling these needs in the art by providing a process for simultaneously neutralizing positive and negative static electric charges on surfaces. The process consists essentially of contacting a first atmosphere with a positive static charge composition by spraying an effective amount of the positive static charge composition into the first atmosphere so that the resulting treated first atmosphere is capable of neutralizing negative static electric charges on surfaces contacting the treated first atmosphere. A second atmosphere is contacted with a negative static charge composition by spraying an effective amount of the negative static charge composition into the second atmosphere so that the resulting treated second atmosphere is capable of neutralizing positive static electric charges on surfaces contacting the treated second atmosphere. The treated first atmosphere is mixed with the treated second atmosphere to thereby form a mixed atmosphere. At least one surface having positive and negative static electric charges thereon is then contacted with the mixed atmosphere to thereby simultaneously neutralize positive and negative static charges on the at least one surface.

There are a number of advantages provided by this invention. The most important is the ability to simultaneously neutralize positive and negative static electric charges on surfaces of objects. The compositions employed in this invention are comprised mainly of water and are, therefore, of relatively low cost. Moreover, the other ingredients employed in the compositions are readily available. The compositions are very easy to prepare by simply mixing the ingredients together. Since the compositions employed are usually in liquid form, it is particularly easy to automatically feed them into conventional air-washer systems. The process of this invention can be tailored to suit environments containing both negative and positive static electric charges of differing magnitudes. This invention makes it possible to neutralize static charges in a predictable, controllable and reproducible manner.

BRIEF DESCRIPTION OF THE DRAWING

This invention will be better understood by reference to the drawing in which the FIGURE is a diagrammatic illustration of the apparatus employed in the Examples set forth hereinafter.

The process of this invention involves treating atmospheres with certain compositions described more fully hereinafter, wherein a mixed atmosphere is formed that is capable of simultaneously neutralizing some or all of the positive and negative static electrical charges on objects with which the mixed atmosphere comes in contact. This invention involves the use of a first atmosphere and a second atmosphere that are combined to form the mixed atmosphere. The first and second atmospheres can be comprised of the same constituents or different constituents. Generally, the atmospheres will be air, although other atmospheres can be employed provided that the constituents of the atmospheres do not substantially chemically react with each other or with positive and negative static charge compositions with which they are treated. Thus, for example, an inert gas atmosphere can be employed. Typical of the constituents in such an inert gas atmosphere are nitrogen and the noble gases, such as helium, neon, argon, krypton and xenon. The atmosphere can be comprised of a single element or compound or mixture of several elements and compounds. The term "atmosphere" is intended to include both gases and vapors. The atmospheres can be in the form of streams into which the positive and negative static charge compositions are sprayed.

The spraying operation employed in this invention can be conducted in spray systems well known in the art. A number of spray systems are in commercial use. Typical of such systems are spray columns, cyclone sprayers, venturi air-washers, and jet scrubbers or washers. The spray system generally includes a spray nozzle or a series of spray nozzles, which can form, for example, a spray manifold. This invention is especially useful in air-washers of the type employed in textile plants.

As used herein, the term "spray nozzle" refers to the device for breaking into droplets the aqueous solution of this invention. Generally speaking, the spray nozzle can be a pressure nozzle, rotating nozzle (spinning atomizer) or a gas-atomizing nozzle (two fluid nozzle, pneumatic atomizer). Spray nozzles employed in air moistening, air washing, humidification, scrubbing and washing of gases are well known in the art. Typical examples of nozzles include solid-cone wide-angle sprayers, narrow-angle sprayers, hollow-cone sprayers, pressure atomizing spray nozzles, air- or gas-atomizing sprayers and rotating-disk sprayers.

The term "spraying" is to be understood as the process of dispersing a liquid in a gas or vapor, and the products obtained from such a process include sprays, mists, and fogs. Essentially, the spraying operation employed in this invention involves the formation of a suspension or dispersion of minute particles or clusters of minute particles in a gas.

The first atmosphere, such as an air stream, is contacted with a positive static charge composition by spraying an effective amount of the composition into the first atmosphere. If an object having negative static charges on its surface was then contacted with the resulting treated first atmosphere, all or part of the negative static charge would be neutralized. In the practice of this invention, however, the treated first atmosphere is mixed with a treated second atmosphere to form the mixed stream, which is then contacted with objects having positive and negative static charges. As used herein, the expression "positive static charge composition" means a substantially aqueous system that can be sprayed into an atmosphere so that the resulting treated atmosphere is capable of neutralizing negative static charges on objects with which it comes in contact. An "effective amount" of the positive static charge composition means that amount of the composition that will give the desired degree of negative static charge neutralization in the environment being treated, and will depend upon the nature of the positive static charge composition and the magnitude of the negative charges in the environment. These amounts can be determined with a minimum of experimentation.

As used herein, the term "consisting essentially of" is to be given its generally accepted meaning as requiring that specified components be present, but not excluding unspecified conditions or materials that do not materially detract from the basic and novel characteristics of the invention and do not prevent the advantages of the invention from being realized.

This invention can be carried out with positive static charge compositions generally. A number of such compositions are known in the art. A suitable positive static charge composition consists essentially of an aqueous solution comprising about 500 to about 3000 ppm of a composition consisting essentially of borax and at least one surfactant selected from the group consisting of (a) a nonionic surfactant having an HLB number of 6.6, (b) a nonionic surfactant having an HLB number of 3.0, (c) a liquid, nonionic, fatty acid alkylolamide.

The borax and surfactant are present in the aqueous solution in a weight ratio of borax to surfactant of about 1.2:1 to about 15:1. Typically, the first atmosphere is contacted with this aqueous solution for about 0.1 to about 10 seconds at a temperature between about 15° C. and the boiling point of the aqueous solution.

The time during which the spray of aqueous borax/surfactant solution contacts the first atmosphere affects the magnitude of the negative electrical charges that can be neutralized. The ability to neutralize negative electrical charges increases with increases in contact time.

As used herein, the term "borax" refers to sodium borate and its various hydrates. Typical of the sodium borate-hydrates are the decahydrate, metaborate, metaboratetrahydrate, tetraborate, tetraborate pentahydrate and perborate and its hydrates. The borax can be used in any of its technical and commercial grades. The term "HLB number" is used herein in its conventional sense as being an expression of the hydrophile-lipophile balance of the surfactant. It is a measure of the size and strength of the hydrophilic and the lipophilic groups of the surfactant.

Another suitable positive static charge composition consists essentially of an aqueous solution comprising at least one quaternary ammonium compound of the formula:

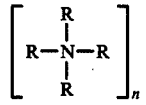

X (I)

The R- groups in formula (I) can be identical to each other or different from each other. Typically, the concentration of quaternary ammonium compound in the aqueous solution is about 0.5 to about 20 ppm.

In one embodiment of this invention, each of the R-groups has the same number of carbon atoms and is selected from the group consisting of $C_3$ to $C_8$ substituted or unsubstituted aliphatic groups. The quaternary ammonium compound is soluble in water to an extent of at least about 0.5 ppm at about 20° C. If the R- groups contain too many carbon atoms, the water solubility of the quaternary ammonium compound may be adversely affected. This may require the use of auxiliary water miscible solvents in the preparation of an aqueous solution of the quaternary ammonium compound by first dissolving the quaternary ammonium compound in the water miscible solvent and then dissolving the resulting solution in water. The aliphatic groups can be branched or straight chain. It will of course be understood that the aliphatic groups can be stereoisomers. Preferably, the aliphatic groups are alkyl groups because of the ready availability of quaternary ammonium compounds containing such groups. Typical of such compounds are tetrabutyl ammonium chloride and tetrabutyl ammonium bromide, the latter compound being particularly preferred in this invention. The aliphatic group can also be unsaturated, for example, ethylenically unsaturated, in which case it would be expected that the solubility of the quaternary ammonium compound in water would be improved.

In another embodiment, each of the R- groups has the same number of carbon atoms and is selected from the group consisting of $C_3$ to $C_8$ substituted or unsubstituted cyclic groups. Typical of these groups are cycloaliphatic groups, such as cyclobutyl and cyclohexyl groups, cycloalkenyl groups, such as cyclohexene or cyclohexadiene groups, and aromatic groups, such as phenyl or benzyl groups.

In a further embodiment the R- groups are different. More particularly, one or two of the R- groups can be independently selected from $C_8$ to $C_{18}$ substituted or unsubstituted aliphatic or cyclic groups and the remaining R- groups are independently selected from substituted or unsubstituted $C_1$ or $C_2$ groups. Here again, there is wide latitude in selecting straight or branch chain, saturated or unsaturated aliphatic groups. Preferably, the aliphatic group is alkyl, but the aliphatic group can also contain unsaturation, such as ethylenic unsaturation. When one or more of the R- groups is cyclic, each will typically be cycloalkyl, cycloalkenyl or aromatic. Typical of the compounds within this class are n-alkyl benzyl ammonium halides, such as the chlorides and bromides. Preferred compounds within this group are mixtures of n-alkyl dimethyl benzyl ammonium chlorides and n-alkyl dimethyl ethylbenzyl ammonium chlorides in which the n-alkyl groups are mixtures of $C_{12}$ and $C_{18}$ alkyl groups. Particularly preferred are such compounds in which the n-alkyl of the dimethyl benzyl ammonium chloride is a mixture containing in weight percent about 60% $C_{14}$ groups, about 30% $C_{16}$ groups, about 5% $C_{12}$ groups and about 5% $C_{18}$ groups, and the n-alkyl of the dimethyl ethylbenzyl ammonium chloride is a mixture containing in weight percent about 50% $C_{12}$ groups, about 30% $C_{14}$ groups, about 17% $C_{16}$ groups and about 3% $C_{18}$ groups. These compounds are marketed under the trade name BARQUAT 4280Z by Lonza, Inc.

The value of n in formula (I) is 1, 2 or 3. This value is generally dictated by the valence of the anion X, which can be any inorganic anion, provided that the quaternary ammonium compound is soluble in water to an extent of at least about 0.5 ppm at about 20° C. Typical of suitable inorganic anions are halides, such as F, Cl, Br and I, sulfate, nitrate and phosphate. Chloride and bromide are preferred.

It will be understood that the R- groups can be substituted by hydrocarbons. For example, the R-groups can be aralkyl or alkaryl. While it is preferred that the R-groups in formula (I) be hydrocarbons, one or more of the R- groups can contain other substituents. For example, one or more of the R- groups can be substituted by at least one member selected from the group consisting of Cl, F, Br, I, OH, $NO_2$, $HSO_3$, $NH_2$—, NH=, or an organic functional group, such as COOH—, CHO—, $$-\overset{O}{\overset{\|}{C}}-,\ -O-,\ -\overset{O}{\overset{\|}{C}}-NH_2,$$

—C≡N and —$CNH_2$ groups. When the R- groups are substituted, it is preferred that the substituents be predominantly hydrophobic.

The amount of the quaternary ammonium compound of formula (I) in the aqueous solution sprayed into the first atmosphere is generally about 0.5 to about 20 ppm.

Still another positive static charge composition is dodecylbenzyl triethyl ammonium chloride in aqueous solution. Use of this system is disclosed in U.S. Pat. No. 3,939,080.

Considering further the process of this invention, the second atmosphere is contacted with a negative static charge composition by spraying an effective amount of the composition into the second atmosphere. If an object having positive static charges on its surface was then contacted with the resulting treated second atmosphere, all or part of the positive static charges would be neutralized. Before that, however, the treated first atmosphere is mixed with the treated second atmosphere to form the mixed stream, which is then contacted with objects having positive and negative static charges. As used herein, the expression "negative static charge composition" means a substantially aqueous system that can be sprayed into an atmosphere so that the resulting treated atmosphere is capable of neutralizing positive static charges on objects with which it comes in contact. An "effective amount" of the negative static charge composition means that amount of the composition that will give the desired degree of positive static charge neutralization in the environment being treated, and will depend upon the nature of the negative static charge composition and the magnitude of the positive charges in the environment. These amounts can be determined with a minimum of experimentation.

Similar to the positive static charge compositions, this invention can be carried out with negative static charge compositions generally. A number of such compositions are suitable, the simplest and least expensive being tap water (see Examples 1 and 5 hereinafter).

Another suitable negative static charge composition consists essentially of an aqueous solution consisting essentially of at least one surfactant, other than a quaternary ammonium compound of formula (I). The surface tension of water against air at 20° C. is 72.75 dynes/cm, and the surfactant employed should be capable of being dissolved in such water to thereby form a surfactant solution having a surface tension against air of about 38 to about 60 dynes/cm at about 20° C. when the surfactant solution contains about 0.0005 to about 0.1 weight percent of the surfactants.

Typical of the surfactants that can be employed are polyoxyethylene compounds terminated at each end of the molecule by hydrophilic polyoxyethylene groups. They can be represented by the simplified structure:

$$HO(CH_2CH_2-O)_a(\underset{\underset{CH_3}{|}}{CH_2}-CH_2-O)_b(CH_2CH_2-O)_cH\ .$$

A specific example of such a surfactant is Pluronic L-62-LF, which is a condensate of ethylene oxide with a hydrophobic base formed by condensing propylene oxide with propylene glycol. It is a nonionic surfactant having an HLB number of 6.6 and is a liquid available in 100 percent concentration.

Another suitable surfactant is a nonionic surfactant having an HLB number of 3.0. An example of a commercially available surfactant of this type is Pluronic L-61, which is similar in chemical structure to Pluronic L-62-LF. Pluronic L-61 is a liquid having a total average molecular weight of about 1950 and an average molecular weight of the polyoxypropylene base of about 1750. Pluronic L-62-LF is a liquid having an average molecular weight of about 2200, of which about 1750 comprises the polyoxypropylene base. Pluronic L-61 and Pluronic L-62-LF are available from Wyandotte Chemical Corporation.

Another suitable surfactant for use in this invention is an anionic sulfonate. An example of a commercially available surfactant of this type is Petro 22. Petro 22 is a sodium methyl naphthalene sulfonate available from Petro Chemical Company, Inc.

Other suitable surfactants are caprylic dicarboxylate imidazoline derivatives. Typical of such surfactants is Cycloteric MV-SF, which is an amphoteric surfactant available from Cyclo Chemicals Corp.

Other suitable surfactants include modified oxyethylated straight-chain alcohols, such as Plurafac RA-10, which is a non-ionic surfactant available from BASF Wyandotte Industries Chemicals Group.

A particularly preferred surfactant for use in this invention is comprised of a mixture of Cycloteric MV-SF and Plurafac RA-10 in a weight ration of 3:2.

The amount of surfactant employed is generally about 0.5 to about 50 ppm.

The treated first atmosphere and the treated second atmosphere are then combined to form a mixed atmosphere. If the mixed atmosphere comes in contact with an object that has a positive or negative static electrical charge, the magnitude of the static charge will be substantially reduced and can even be completely neutralized. It is also possible to simultaneously neutralize positive and negative static charges on objects. This is particularly advantageous in the textile industry in which processing operations can give rise to both positive and negative static electrical charges.

Another feature of the present invention is that it is possible to tailor the mixed atmosphere to neutralize static charges of different magnitude. The positive static charge composition makes it possible to neutralize negative charges on objects, whereas the negative static charge composition makes it possible to neutralize positive charges. Thus, if one encounters an environment in which the magnitude of negative static charges is greater than the magnitude of positive static charges, a proportionately larger amount of positive static charge composition can be employed. Conversely, if positive static charges are of larger magnitude, a smaller amount of positive static charge composition or a larger amount of negative static charge composition can be employed. The magnitude and type of charge on objects can be predicted for many systems using the well-known triboelectric series.

The results obtained according to the present invention are indeed surprising. When the two streams are mixed, it would be expected that one of three possible events would occur: the resulting mixed atmosphere would either have a net positive charge, a net negative charge or a charge of zero. In any case, it would have been expected that either negative or positive charges (but not both) could be neutralized, or if the net charge was zero on the mixed atmosphere no neutralization would occur. For some unknown reason, the mixed atmosphere prepared according to the process of this invention can simultaneously neutralize both positive and negative static electrical charges on objects.

BEST MODE FOR CARRYING OUT THE INVENTION

One way of carrying out this invention is described in detail below with reference to the drawing. In the following Examples, all parts, proportions, percentages and ratios are by weight unless otherwise indicated.

DESCRIPTION OF THE TEST PROCEDURE AND APPARATUS

The FIGURE is an illustration of two air-washer apparatuses employed in the following Examples. Air-washer A (left-side of FIGURE) comprises an air-washing chamber 1 formed by a glass pipe 2 having a diameter 3 of about 6" and an overall length of about 42". The glass pipe 2 has an inlet opening 4 at the top and an outlet pipe 5 near the bottom 6 of pipe 2. Air enters inlet 4, which is spaced about 21" from the center of the entry to pipe 5.

A sump generally indicated as 7 is provided and comprises a five-gallon plastic pan containing a positive static charge composition 8 to be sprayed into glass pipe 2. A platic (Tygon) tube 9 of about ⅝ inch inside diameter is submerged in the solution 8 and extends to a pump 10, which pumps the solution from sump 7 through plastic tube 11 up to spray nozzle 12. The pump is a Model 4 MD manufactured by Little Giant Co. The tube 11 is of the same material as tube 9.

Pipe 5 is provided with a plastic anti-carryover baffle 14 that removes entrained liquid carried over from spray 25 in pipe 2. Near the open end 15 of pipe 5 is located a stainless steel plate 16, which is 15 cm square and about 1/100 inch thick. Stainless steel plate 16 is suspended via a styrofoam block 17 maintained in place by means not shown. A Keithley Model 600B electrometer 18 is used to monitor the charge on the plate 16 via a static probe 19 positioned approximately 2–3 millimeters from the plate surface. The electrometer 18 is also isolated from the surroundings by styrofoam blocks 17'. An electrical charge is placed on stainless steel plate 16 by means of a 1000 v. power supply 20 having positive (+) and negative (−) terminals. This is accomplished by contacting stainless steel plate 16 with probe 21 connected to the power supply 20 via a wire 22. The power supply 20 is isolated from the surroundings by styrofoam blocks 17".

As shown in the FIGURE, a positive charge has been placed on plate 16. The electrical apparatus is grounded to a water-pipe to minimize the effects of stray currents.

During operation, the system is activated by starting pump 10, which recirculates the aqueous solution 8 in sump 7 to the spray nozzle 12. Laminar flow of the atmosphere into which the solution is sprayed is preferred. Since the outlet 6 of pipe 2 is submerged in aqueous solution 8, air entering the inlet 4 of pipe 2 must exit through pipe 5. The air flow through pipes 1 and 5 is caused by the venturi effect originating at nozzle 12.

In the following Examples, the sump 7 was charged with the aqueous solution indicated in the respective Example, and the pump 10 is started. Plate 16 was initially grounded by touching it while the electrometer 18 was zeroed to center scale. Power supply 20 was then used to charge the plate 16 either positive or negative, as desired (up to 1000 volts). A reading of 5 indicates full scale deflection. The change in the reading on the electrometer 18 was then observed for a period of 60 seconds and the readings recorded at 10 second intervals. These measurements give an indication of the rate of discharge of the electrical charge on plate 16. At the end of each 60 second run, the plate 16 was grounded so that any meter drift could be observed; these are reported as ground values.

The temperature of the solution sprayed into the air stream in each case was about 21° C., unless otherwise indicated. The water used in all of the Examples was tap water from the public water supply of the city of East Point, Ga.

EXAMPLE 1—SINGLE AIR WASHER WITH TAP WATER

This is a comparative example using tap water in a single air washer.

When tap water alone was added to the sump 7 and plate 16 alternately charged positive and negative, the following electrometer readings were made.

| TIME (Seconds) | CHARGE ON PLATE Negative | Positive |
|---|---|---|
| 0 | 4.6 | 4.4 |
| 10 | 4.6 | 3.1 |
| 20 | 4.55 | 2.0 |
| 30 | 4.55 | 1.2 |
| 40 | 4.55 | 0.6 |
| 50 | 4.55 | 0.2 |
| 60 | 4.2 | 0.0 |
| Ground Value | −0.2 | +0.1 |

These results indicate that a spray of tap water functions as a negative static charge composition by dissipating a positive charge on plate 16 much faster than a negative charge. In fact, it is seen that a spray of tap water alone was relatively ineffective in neutralizing a negative electrical charge in a short period of time.

EXAMPLE 2—SINGLE AIR WASHER WITH WATER+QUATERNARY AMMONIUM COMPOUND

This is also a comparative example in which Example 1 was repeated, except that an aqueous solution containing 1 ppm tetrabutyl ammonium bromide (TBAB) was added to the sump. The following results were observed.

| TIME (Seconds) | CHARGE ON PLATE Negative | Positive |
|---|---|---|
| 0 | 4.4 | 4.4 |
| 10 | 3.4 | 4.2 |
| 20 | 2.7 | 4.1 |
| 30 | 2.0 | 4.0 |
| 40 | 1.5 | 3.8 |
| 50 | 0.9 | 3.7 |
| 60 | 0.5 | 3.6 |
| Ground Value | 0.0 | +0.1 |

TBAB reversed the behavior of a system based on water alone. TBAB in water neutralized a negative charge on the plate more rapidly than it neutralized a positive charge.

EXAMPLE 3—SINGLE AIR WASHER WITH WATER+SURFACTANT

This is a comparative example in which Example 1 was repeated, except that 1 ppm Pluronic L-62-LF was added to the sump. The following results were observed.

| TIME (Seconds) | CHARGE ON PLATE Negative | Positive |
|---|---|---|
| 0 | 5.0 | 5.0 |
| 10 | 4.9 | 2.8 |
| 20 | 4.7 | 1.3 |
| 30 | 4.5 | 0.5 |
| 40 | 4.3 | 0.1 |
| 50 | 4.2 | −0.2 |
| 60 | 4.0 | −0.3 |
| Ground Value | +0.2 | 0.0 |

This Example indicates that a surfactant can accelerate the rate of discharge of positive electrical charges above that normally achieved with water alone. While the plate actually became slightly negative during the sixty second run, this may have been due to the plate picking up excess charge from the air stream. The foregoing effects were maintained up to a surfactant concentration of about 6 to about 8 ppm, at which point the solution behaved very similar to water alone. That is, it was still possible to neutralize positive charges, but the rate of discharge was not as great as with the very low concentrations of surfactant.

Furthermore, as the amount of surfactant was increased, the behavior of the treated air stream toward a negatively charged plate remained substantially unchanged, while the ability of the treated air stream to discharge a positively charged plate was diminished. The following data based on runs at 40 to 80 ppm L-62-LF illustrate this trend.

| TIME (Seconds) | CHARGE ON PLATE 40 ppm (+) | 40 ppm (−) | 80 ppm (+) | 80 ppm (−) |
|---|---|---|---|---|
| 0 | 5.0 | 5.0 | 4.8 | 5.0 |
| 10 | 4.0 | 4.9 | 4.0 | 4.9 |
| 20 | 3.1 | 4.7 | 3.7 | 4.7 |
| 30 | 2.2 | 4.6 | 3.1 | 4.6 |
| 40 | 1.6 | 4.5 | 2.6 | 4.4 |
| 50 | 1.2 | 4.3 | 2.1 | 4.2 |
| 60 | .8 | 4.2 | 1.8 | 4.0 |
| Ground Value | 0.0 | 0.0 | 0.0 | 0.0 |

EXAMPLE 4—DUAL AIR-WASHERS

This Example demonstrates the present invention using two treated air streams. This Example was carried out using the procedure outlined in Example 1 with the addition of air-washer B (right side of FIGURE).

Air-washer B is the same as air-washer A in all respects except that sump 107 of air-washer B was charged with an aqueous solution 108 of a positive static charge composition. Pump 110 was started and drew solution 108 through tubing 109 and discharged the solution in the form of a spray 125 from nozzle 112 via tubing 111. Air entered opening 104 because of the venturi effect originating at nozzle 112.

The air exited air-wash chamber 101 through pipe 105 where entrained liquid was removed by baffle 114.

The resulting treated air stream exited air-washer B at open end 115 of pipe 105.

The treated air stream exiting from open end 15 of air-washer A mixed with the treated air stream discharging from open end 115 of air-washer B in the space 126.

In this Example, the negative static charge composition in sump 8 was tap water. The positive static charge compositions in sump 108 was an aqueous solution containing 2 ppm tetrabutyl ammonium bromide (TBAB). The plate 16 was alternately charged positive and negative as previously described and the following electrometer readings were made.

| TIME (Seconds) | CHARGE ON PLATE Negative | Positive |
|---|---|---|
| 0 | 5.0 | 5.0 |
| 10 | 2.6 | 4.5 |
| 20 | 1.4 | 4.0 |
| 30 | .8 | 3.0 |
| 40 | .2 | — |
| 50 | 0. | 2.1 |
| 60 | −0.1 | 1.5 |

Notwithstanding the mixing of the treated streams from air-washers A and B, it was still possible to neutralize both positive and negative electric charges on plate 16. This is surprising since it would have been expected that the streams would have neutralized each other so that the resulting stream would have a zero charge or a net negative or net positive charge.

EXAMPLE 5—TAP WATER ONLY IN DUAL AIR-WASHERS

This is a comparative example in which Example 4 was repeated, except that both sump 8 and sump 108 were charged with tap water. When plate 16 was alternately charged positive and negative, the following electrometer readings were made:

| TIME (Seconds) | CHARGE ON PLATE Positive | Negative |
|---|---|---|
| 0 | 5.0 | 5.0 |
| 10 | 2.2 | 5.0 |
| 20 | 1.0 | 5.0 |
| 30 | 0.0 | 5.0 |
| 40 | −0.4 | 5.0 |
| 50 | −0.6 | 5.0 |
| 60 | −0.8 | 5.0 |

This Example 5 demonstrates that even using dual air-washers it is not possible to neutralize negative static charges unless a positive static charge composition is employed in one air-washer. This Example serves to verify the results obtained in Example 1 in that tap water functions as a negative static charge composition. It will be observed that the rate of discharge of positive charges was greater in this Example 5 than in Example 1, probably due to the increased volume of treated air without a corresponding increase in the size of plate 16.

While the operation of this invention has been demonstrated in Example 4 with two air-washers, it will be understood that more than two air-washers can be utilized. Similarly, while the invention has been described herein as based on a first atmosphere and a second atmosphere, it will be understood that a multiplicity of atmospheres can be employed by treating at least one of the atmospheres with a negative static charge composition and at least one of the atmospheres with a positive static charge composition as needed to obtain the desired type of charge (i.e., positive and/or negative) and magnitude of charge neutralization. For example, the number of streams treated with positive static charge compositions could exceed the number of streams treated with negative static charge compositions where negative static charges predominate on objects being treated. It will also be understood that the static charge composition for each stream can be independently selected from those that generally can be employed. For example, the positive static charge composition need not be the same for each stream treated in a multiple stream system. Likewise, different negative static charge compositions can be sprayed into the various streams of a multiple stream system.

In practicing the process of this invention, the amount of positive static charge composition and the amount of negative static charge composition sprayed into each respective atmosphere can be varied over a wide range as previously described. The amount of each composition sprayed can be up to the saturation point of the atmosphere into which it is sprayed, the saturation point being the point at which no more of the sprayed composition can be carried by the flowing atmosphere. Beyond the saturation point, objectionable deposits of the compositions on surfaces may be encountered.

The positive and negative static charge compositions can include other additives that do not materially detract from the ability to neutralize positive and negative static electric charges. Typical of optional additives are antifoaming agents; corrosion inhibitors; anti-oxidants; chelating agents; colorants, such as dyes and pigments; buffering agents; lubricants; anti-bacterial and anti-fungal agents; odor neutralizers; and small amounts of organic solvents.

INDUSTRIAL APPLICABILITY

The applications for the process of this invention will be immediately apparent to persons skilled in the art of static control. Relatively large and troublesome amounts of static electricity are frequently generated in textile and paper processing. The method and composition of this invention can be employed to substantially reduce or completely neutralize positive and negative static electrical charges in such environments. This invention is suitable for use with air-washer equipment of the type conventionally employed in such installations. Thus, this invention is particularly advantageous since additionally costly equipment is frequently not required.

We claim:

1. A process for simultaneously neutralizing positive and negative static electric charges on surfaces, said process consisting essentially of:

(A) contacting a first atmosphere with a positive static charge composition by spraying an effective amount of said positive static charge composition into said first atmosphere so that the resulting treated first atmosphere is capable of neutralizing negative static electric charges on surfaces contacting said treated first atmosphere;

(B) contacting a second atmosphere with a negative static charge composition by spraying an effective amount of said negative static charge composition with said second atmosphere so that the resulting treated second atmosphere is capable of neutralizing positive static electric charges on surfaces contacting said treated second atmosphere;

(C) mixing said treated first atmosphere with said treated second atmosphere to thereby form a mixed atmosphere; and (D) contacting at least one surface having positive and negative static electric charges thereon with said mixed atmosphere to thereby simultaneously neutralize positive and negative static charges on said at least one surface.

2. Process according to claim 1 wherein said first atmosphere and said second atmosphere are independently selected from the group consisting of air, nitrogen, noble gases and mixtures thereof.

3. Process according to claim 2 wherein said negative static charge composition is water.

4. Process according to claim 2 wherein said positive static charge composition is an aqueous solution consisting essentially of tetrabutyl ammonium bromide.

5. Process according to claim 2 wherein said positive static charge composition is an aqueous solution consisting essentially of dodecylbenzyl triethyl ammonium chloride.

6. Process according to claim 2 wherein said positive static charge composition is an aqueous solution consisting essentially of about 500 to about 3000 ppm of a composition comprising (1) borax, and (2) a surfactant selected from the group consisting of (a) a nonionic surfactant having an HLB number of 6.6, (b) a nonionic surfactant having an HLB number of 3.0, and (c) a liquid, nonionic fatty acid alkylolamide;

the weight ratio of borax to surfactant being about 1.2:1 to about 15:1.

7. Process according to claim 2 wherein said positive static charge composition is an aqueous solution consisting essentially of about 0.5 to about 20 ppm of at least one quaternary ammonium compound of the formula

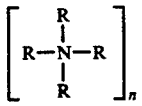

X wherein (1) each of the R- groups is the same and is selected from the group consisting of $C_3$ to $C_8$ substituted or unsubstituted aliphatic or cyclic groups; or (2) one or two of the R- groups are independently selected from $C_8$ to $C_{18}$ substituted or unsubstituted aliphatic or cyclic groups and the remaining R- groups are independently selected from substituted or unsubstituted $C_1$ to $C_2$ groups;

X is an inorganic anion; n equals 1, 2 or 3; said quaternary ammonium compound being soluble in water to an extent of at least about 0.5 ppm at about 10° C.

8. Process according to claim 7 in which each of said R- groups is a branched or straight chain aliphatic group.

9. Process according to claim 7 wherein at least one of said R- groups is an unsaturated alkyl group.

10. Process according to claim 7 wherein at least one of said R- groups is an unsaturated alkyl group.

11. Process according to claim 7 in which at least one of said R- groups is substituted by at least one member selected from the group consisting of Cl, F, Br, I, OH, $NO_2$, $HSO_3$, $NH_2$—, NH<, COOH—, CHO—, $$-\overset{O}{\overset{\|}{C}}-,\ -O-,\ -\overset{O}{\overset{\|}{C}}-NH_2,$$

—C≡N, —$CNH_2$ groups and in which said quaternary ammonium compound is capable of forming micelles in aqueous solution.

12. Process according to claim 7 wherein at least one of said R- groups is a substituted or unsubstituted aryl group.

13. Process according to claim 7 wherein each of the R- groups is identical.

14. Process according to claim 7 in which X is a chloride, fluoride, bromide, iodide, sulfate, nitrate or phosphate ion.

15. Process according to claim 2 wherein said negative static charge composition is an aqueous solution consisting essentially of about 0.5 to about 50 ppm of at least one surfactant capable of being dissolved in water having a surface tension against air of about 72.75 dynes/cm at 20° C. to thereby form a surfactant solution having a surface tension against air of about 38 to about 60 dynes/cm at 20° C. when said surfactant solution contains about 0.0005 to about 0.1 weight percent of said surfactant.

16. Process according to claim 15 in which said surfactant is selected from the group consisting of (a) a nonionic surfactant having an HLB number of 6.6, (b) a nonionic surfactant having an HLB number of 3.0, (c) an amphoteric caprylic dicarboxylate imidazoline derivative surfactant, (d) a nonionic modified oxyethylated straight chain alcohol surfactant, and (e) an anionic sodium sulfonate.

17. Process according to claim 15 in which said surfactant is comprised of a mixture of (a) an amphoteric caprylic dicarboxylate imidazoline derivative surfactant, and (b) a nonionic modified oxyethylated straight chain alcohol surfactant.

18. Process according to claims 1, 4, 6, 7, 15, 16 or 17 in which said treated first atmosphere, said treated second atmosphere or both of said treated atmospheres are in laminar flow.

19. Process according to claim 1 in which said first atmosphere, said second atmosphere or both of said atmospheres are comprised of a multiplicity of gaseous streams into which said compositions are sprayed.

* * * * *